US005964237A

United States Patent [19]

Lin

[11] Patent Number: 5,964,237

[45] Date of Patent: Oct. 12, 1999

[54] SUPPORTING SHAFT OF A SUNSHADE

[76] Inventor: Chen-Hsiung Lin, No. 174, Ding Tan, Pi Tan Village, Lu Tsao Hsiang, Chia YiHsien, Taiwan

[21] Appl. No.: 09/140,767

[22] Filed: Aug. 26, 1998

[51] Int. Cl.[6] ..... A45B 3/00; F16M 13/00; A45F 1/16

[52] U.S. Cl. ..... 135/114; 135/25.4; 135/99; 135/908; 403/377; 285/302

[58] Field of Search ..... 135/25.1, 25.4, 135/26, 29, 31, 33.2, 33.41, 114, 99, 908, 139, 141; 403/377; 205/302

[56] References Cited

U.S. PATENT DOCUMENTS

| | | | |
|---|---|---|---|
| 918,579 | 7/1909 | Murch . | |
| 2,368,692 | 2/1945 | Wallance . | |
| 2,685,353 | 8/1954 | Caskie . | |
| 3,703,182 | 11/1972 | Uthemann | 135/20 R |
| 3,705,593 | 12/1972 | Weber | 135/20 |
| 3,785,388 | 1/1974 | Schafer | 135/20 R |
| 3,833,012 | 9/1974 | McAllister | 135/15 PQ |
| 4,077,420 | 3/1978 | Schultes | 135/25 R |
| 4,077,421 | 3/1978 | Schultes et al. | 135/25 R |
| 4,105,039 | 8/1978 | Schultes et al. | 135/25 A |
| 4,111,217 | 9/1978 | Victor | 135/15 PQ |
| 4,474,200 | 10/1984 | Kida | 135/20 R |
| 4,474,201 | 10/1984 | Kida | 135/20 R |
| 5,144,780 | 9/1992 | Gieling et al. | 52/298 |
| 5,370,144 | 12/1994 | Yang | 135/25.31 |
| 5,593,239 | 1/1997 | Sallee | 403/109 |
| 5,634,482 | 6/1997 | Martin | 135/16 |
| 5,720,311 | 2/1998 | Lin et al. | 135/25.1 |

*Primary Examiner*—Christopher T. Kent
*Assistant Examiner*—Yvonne Horton-Richardson
*Attorney, Agent, or Firm*—Rosenberg, Klein & Bilker

[57] ABSTRACT

A supporting shaft of a sunshade of the present invention includes plurality of supporting rods separately disposed together to form a main shaft, an upper connecting cap and a lower connecting cap separately connected to upper ends and lower ends of the main shaft respectively as the securing means, a sliding block movably fitted around the main shaft. Stretching ribs provided to stretch open or fold close the sunshade are pivoted to the sliding block. Plurality of bent pipes are separately coupled to corners of the sunshade so that the supporting rods, separated, can be coupled thereto to change the sunshade into a tent with the supporting rods supporting the sunshade from the corners.

2 Claims, 6 Drawing Sheets

SUPPORTING SHAFT OF A SUNSHADE

BACKGROUND OF THE INVENTION

This invention concerns a sunshade, particularly one having a main shaft which can either support the sunshade from the center thereof or be dismantled into plurality of supporting rods, which then can be coupled to bent pipes on corners of the sunshade so as to change the sunshade into a tent.

Sunshade are widely used in a leisure plaza, outdoor coffee seats, in a private villa, etc. for shading bright sunshine from people enjoying recreational activities. Known conventional sunshade has main shaft support it from the center thereof and is used in this way only. Nowadays, products having multifunctions will be more competitive than an unifunctional one in the market. From this view point, a main supporting shaft of a sunshade, which can be dismantled and coupled to the corners of the sunshade is devised in the present invention so that a user can esaily change the sunshade into a tent according to his/her demands.

SUMMARY OF THE INVENTION

This invention has been devised to offer a kind of sunshade having a main shaft which can either support the sunshade from the center thereof as a traditional sunshade or be dismantled into plurality of supporting rods so that the supporting rods are respectively coupled to corner bent pipes of the sunshade to support the same. Thus, the sunshade of the present invention having the separable supporting rods which can be combined to form a main shaft, can be used as a traditional sunshade as well as a tent.

Furthermore, an upper connecting cap and a lower connecting cap are provided to separately secure the combined supporting rods from the upper end and the lower end respectively by means of fixing protrusions of the caps respectively inserted into holes of the supporting rods.

BRIEF DESCRIPTION OF DRAWINGS

The invention will be better understood by referring to the accompanying drawings, wherein.

DETAILED DESCRIPTION OF THE PREFERRED EMBODIMENTS

Figure 1:
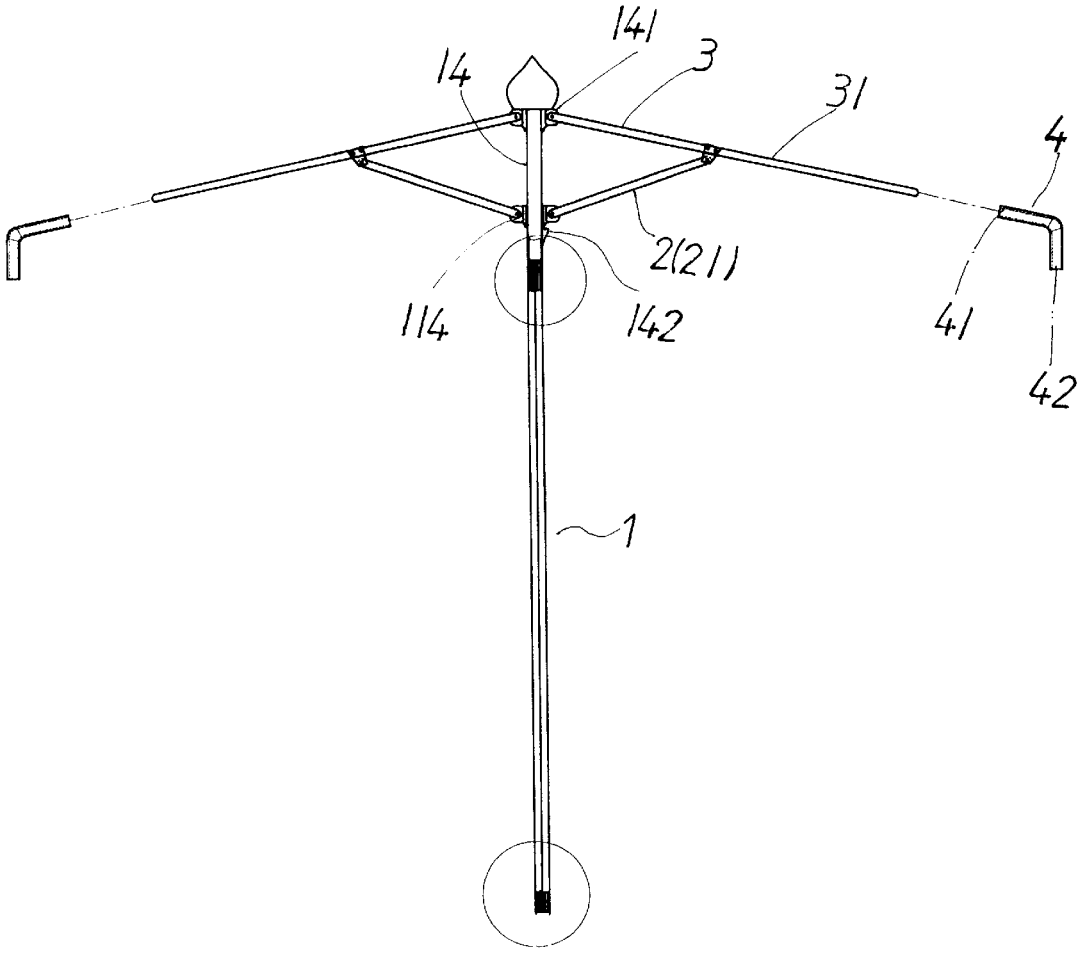
FIG. 1 is a side view of a supporting shaft of a sunshade of the present invention.
Figure 3:
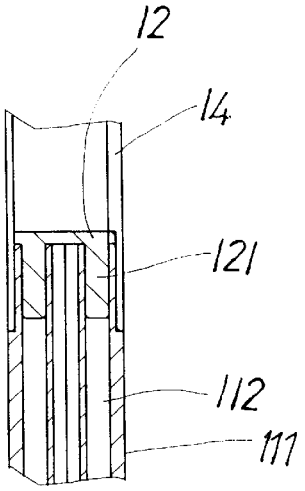
FIG. 3 is a fragmental section view of the main shaft set (upper end) of the present invention.
Figure 4:
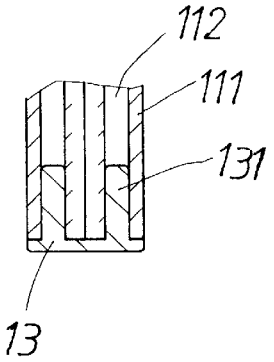
FIG. 4 is a fragmental section view of the main shaft set (lower end) of the present invention.

A sunshade of the present invention, referring to FIG. 1, includes a main shaft set 1, a supporting rib set 3, a stretching rib set 2, bent pipes 4 and shading canvas 5.

Figure 2:
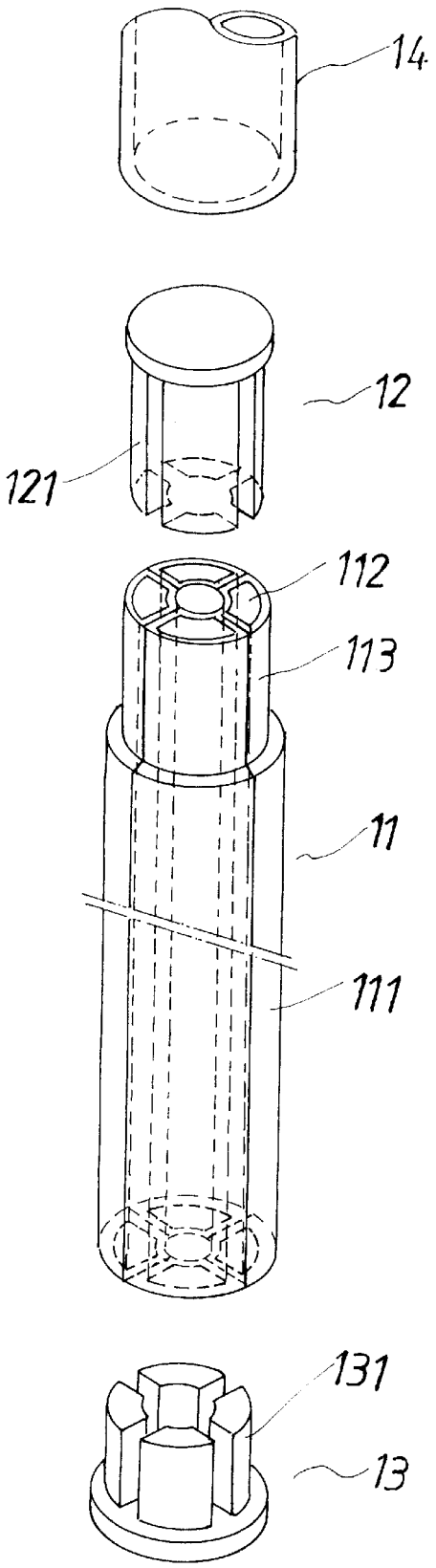
FIG. 2 is a perspective exploded view of the main shaft of the sunshade of the present invention.
Figure 5:
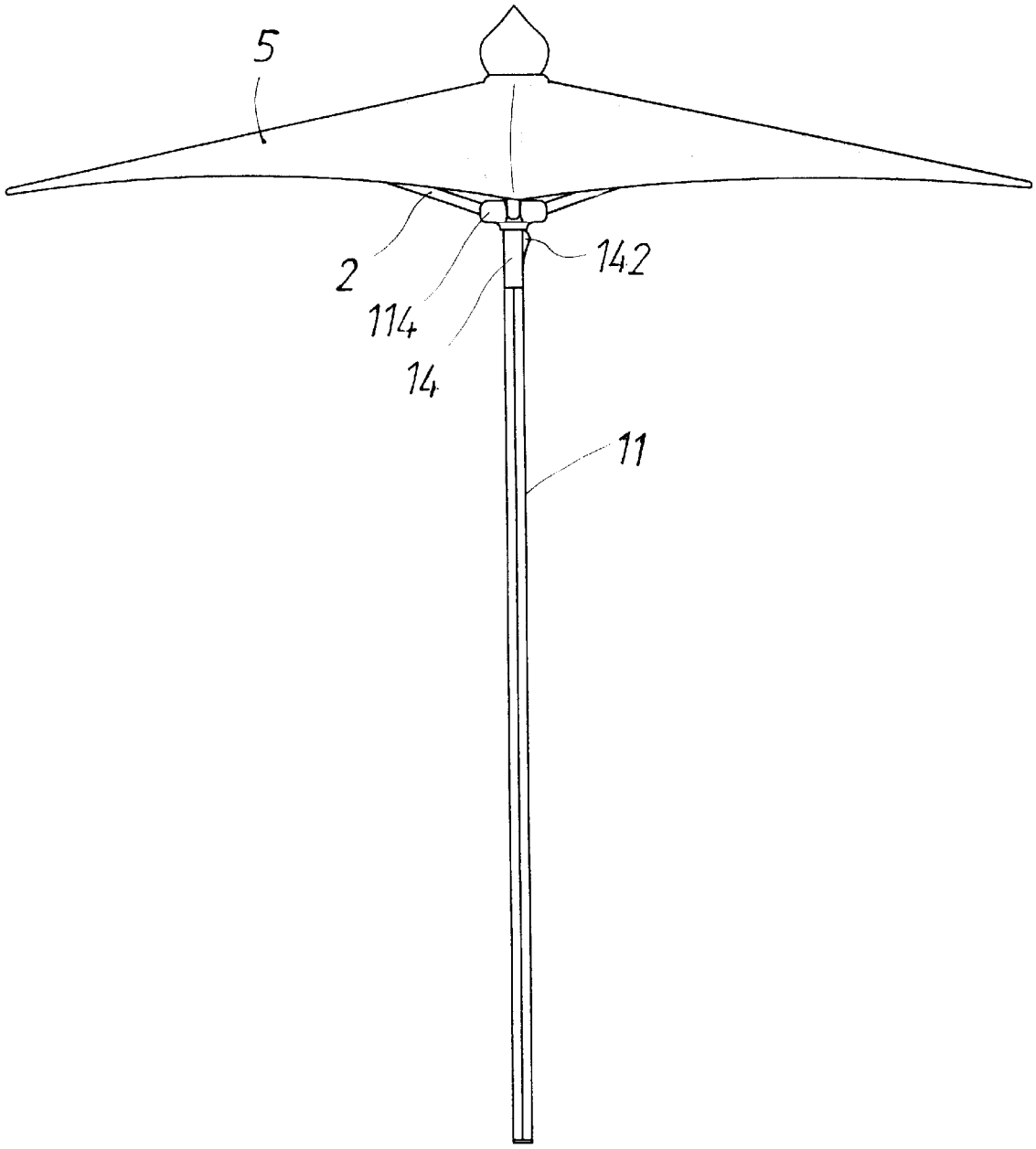
FIG. 5 is a side view of a sunshade of the present invention.
Figure 6:
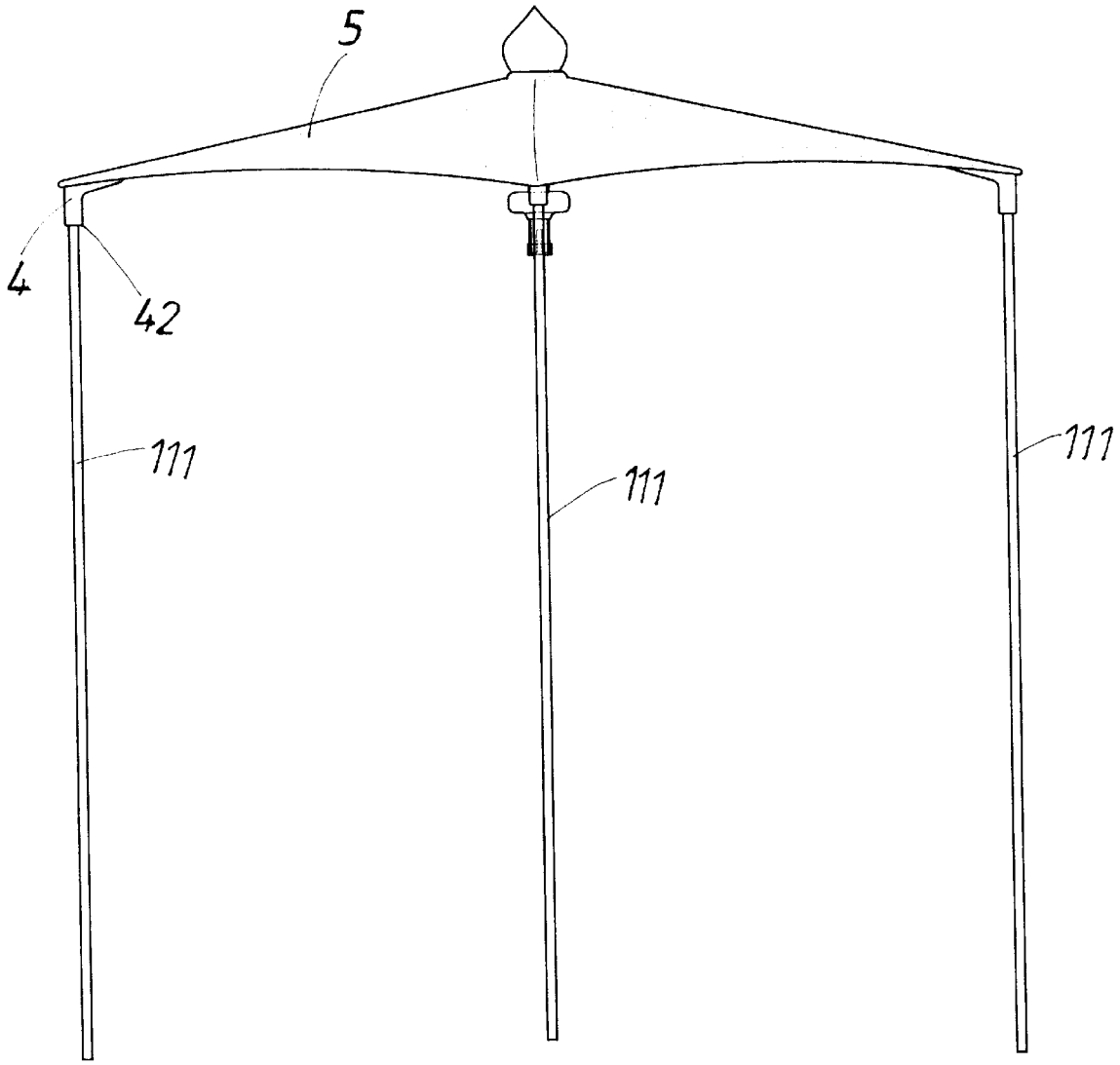
FIG. 6 is a side view of a sunshade of the present invention with the supporting rods separated and coupled to the corner bent pipes.

The main shaft set 1, as shown in FIGS. 1 and 2, comprises a main shaft 11, an upper connecting cap 12, a lower connecting cap 13, an upper pipe 14 and a sliding block 114; the main shaft 11 consists of a plurality of supporting rods 111 (four in this embodiment) each having a sector-shaped cross-section and a holding hole 112. The four supporting rods 111 are separately disposed together to form the main shaft 11 of round cross section and are shaped in such a manner so that the main shaft 11 has an upper connecting end 113, having a smaller circumference than the lower portion thereof. The upper connecting cap 12 and the lower connecting cap 13 are each provided with four fixing protrusions 121, 131, substantially having sector-shape cross section, so that the holding holes 112 of the supporting rods 111 can fittingly retain the fixing protrusions 121,131 of the connecting caps 12,13 therein to bring together the supporting rods 111.

The upper pipe 14 is inserted with the upper connecting end 113 of the main shaft 11 so as to couple the upper pipe 14 to the main shaft 11. Furthermore, the upper pipe 14 is provided with a connecting part 141 at the upper end thereof for support ribs 31 of the support rib set 3 to be pivotally connected thereto, and a button 142 at the lower end thereof. The sliding block 114 is provided to fit movably around the main shaft 11 and pivotally connect with a first end of each of stretching ribs 21 of the stretching rib set 2. The other end of each of the stretching ribs 21 is pivotally connected to an intermediate portion of the respective support rib 31.

Each of the bent pipe 4 has pipe holes 41 and 42; the pipe hole 41 of each of the bent pipes 4 is coupled to the respective supporting rib 31 with the pipe holes 42 facing downward.

In combination, the assembled main shaft 11, consisting of the four supporting rods 111 and combined with the caps 12,13 and the upper pipe 14, is inserted through the sliding block 114. Then, the sliding block 114 is pushed upward to pass over the button 142 so as to be obstructed from sliding downward by means of the button 142; thus, the support rib set 3 and the stretching rib set 2 are stretched open to support the shading canvas 5 for shading sun. When a user wants to fold the sunshade of the present invention, he can press the button 142 to allow the sliding block 114 to slide downward so that the support rib set 3 and the stretching rib set 2 are folded down.

Moreover, when the user wants to change the sunshade into a tent, he simply separates the four supporting rods 111 forming the main shaft 11 and couples each of the supporting rods 111 to a respective one of the pipe holes 42 of the bent pipes 4 so as to support the sunshade from four corners thereof.

Figure 7:
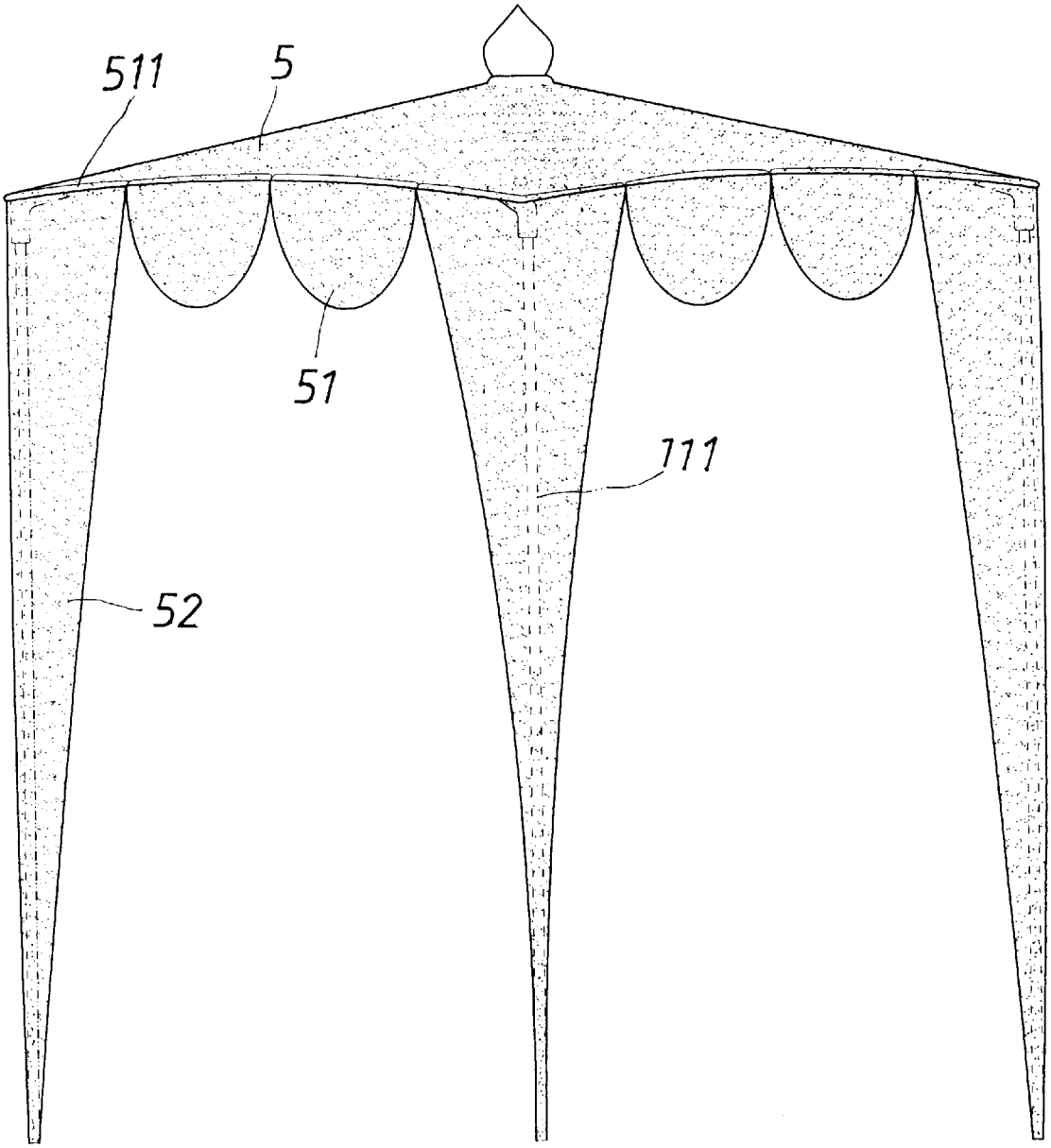
FIG. 7 is a side view of a sunshade of the present invention with the supporting rods disposed on the corners, wave shape and triangle shape canvases attached thereto.
Figure 8:
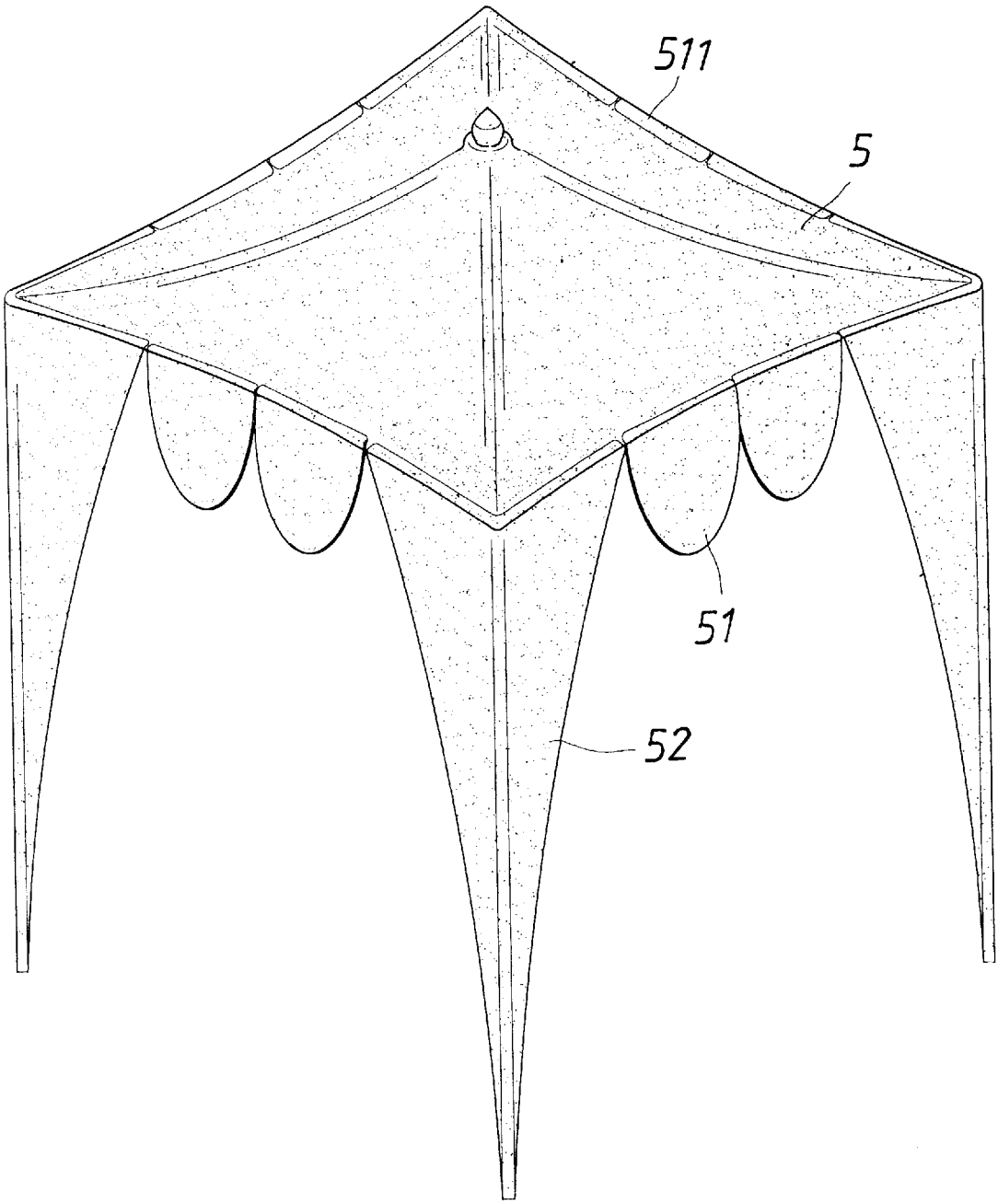
FIG. 8 is a perspective view of the sunshade of the present invention with the supporting rods diaposed on the corners, wave shape and triangle shape canvases attached thereto.

For more ornamentations, referring to FIGS. 7 and 8, the sunshade of the present invention can be provided with canvases of wave shape 51 and of triangle shape 52, fixed to the sunshade combination by means of Velcro 511, wherein the canvases of triangle shape 52 can, in association with the supporting rods 111, touch the ground to look beautiful.

From the above description, it can be understood that the sunshade of the present invention has an advantage over prior art sunshade, to serve as a tent besides as a traditional sunshade.

What is claimed is:

1. A supporting shaft of a sunshade comprising (a) a main shaft having a plurality of supporting rods separately disposed together to form said main shaft, (b) an upper connecting cap having fixing protrusions separately coupled to holding holes of upper protions of said supporting rods, (c) a lower connecting cap having fixing protrusions separately coupled to holding holes of lower portions of said supporting rods, (d) a sliding block pivotally connected to stretching ribs of said sunshade and movably fitted around said main shaft, said stretching ribs being pivotally connected to an inter mediate portion of a respective support rib provided to support a shading canvas, said support rib being pivoted to a connecting part of an upper pipe coupled to outward ends of said support ribs, each having a pipe hole facing downward when combined with said support ribs, said pipe holes being capable of associating with a repective one of said supporting rods after said supporting rods are separated from said caps and from each other.

2. A supporting shaft of a sunshade according to claim 1, wherein wave shape canvases and triangle shape canvas are fitted under said shading canvas and said canvases of triangle shape are stretched downward along said separated supporting rods.

* * * * *